US008414032B2

(12) United States Patent
Yang

(10) Patent No.: US 8,414,032 B2
(45) Date of Patent: Apr. 9, 2013

(54) AUTOMATIC DISCHARGE CONNECTION FOR SUBMERSIBLE PUMP INSTALLATION

(76) Inventor: Tae Yual Yang, Sungman-si (KR)

( * ) Notice: Subject to any disclaimer, the term of this patent is extended or adjusted under 35 U.S.C. 154(b) by 0 days.

(21) Appl. No.: 12/675,265

(22) PCT Filed: May 23, 2008

(86) PCT No.: PCT/KR2008/002884

§ 371 (c)(1),
(2), (4) Date: Jun. 25, 2010

(87) PCT Pub. No.: WO2009/028784

PCT Pub. Date: Mar. 5, 2009

(65) Prior Publication Data

US 2010/0289261 A1 Nov. 18, 2010

(30) Foreign Application Priority Data

Aug. 27, 2007 (KR) ..... 10-2007-0086129

(51) Int. Cl.
*F16L 19/02* (2006.01)

(52) U.S. Cl. ..... 285/325; 277/647; 417/360

(58) Field of Classification Search ..... 285/325; 277/644, 647; 417/360, 361
See application file for complete search history.

(56) References Cited

U.S. PATENT DOCUMENTS 2,950,130 A * 8/1960 Schneider ..... 285/67
3,880,553 A * 4/1975 Wolford et al. ..... 417/360
4,422,472 A * 12/1983 Klein ..... 137/614.06
4,726,742 A * 2/1988 Harbison et al. ..... 417/360
7,137,790 B2 * 11/2006 Youn et al. ..... 417/360
2004/0197207 A1 * 10/2004 Youn et al. ..... 417/360

FOREIGN PATENT DOCUMENTS

| | | |
|---|---|---|
| JP | 08-200278 | 8/1996 |
| KR | 10-0728865 | 6/1997 |
| KR | 10-1998-0067266 | 10/1998 |
| WO | WO 2004/016978 | 2/2004 |

OTHER PUBLICATIONS

International Search Report for PCT/KR2008/002884 dated Aug. 18, 2008.

* cited by examiner

*Primary Examiner* — Aaron Dunwoody
(74) *Attorney, Agent, or Firm* — KED & Associates LLP

(57) ABSTRACT

An automatic discharge connection device of a submersible pump is provided, which includes a coupling member coupled to a discharge port of the submersible pump and a feed pipe that feeds water discharged from the submersible pump. A sealing member is installed in an annular concave portion formed on an inner circumference of the coupling member in such a way as to move left and right. When the submersible pump is actuated, the sealing member moves toward the feed pipe and an end portion of the sealing member enters the feed pipe. Accordingly, a space between the coupling member and the feed pipe is sealed to thereby prevent water leakage between the coupling member and the feed pipe.

18 Claims, 6 Drawing Sheets

AUTOMATIC DISCHARGE CONNECTION FOR SUBMERSIBLE PUMP INSTALLATION

TECHNICAL FIELD

The present invention relates to an automatic discharge connection device of a submersible pump, and more specifically, to a connection structure of a submersible pump and an elbow pipe, which prevents a water leakage between the submersible pump and the elbow pipe.

BACKGROUND ART

FIG. 1 is a perspective view showing an installation process of a typical submersible pump. An elbow pipe 2 is fixed to the bottom of a water tank (not shown), a strut 1 is fixed at the top of the water tank, top ends of a pair of guide bars 3 are fixed to a bracket 9 to which the strut 1 is attached, the bottoms of the guide bars 3 are fixed to the elbow pipe 2, and a coupling member 5 is coupled to one side of a submersible pump 4. In this state, if it is sought to install the submersible pump 4 in the water, if a hoist (not shown) is actuated to hang down a pulling rope 6, the submersible pump 4 falls while being guided to the guide bar 3 by means of its self weight. Thus, a flange 7*a* formed in a discharge port 7 of the submersible pump 4 is coupled to a flange 2*a* formed on the inlet side of the elbow pipe 2, so that the discharge port 7 of the submersible pump 4 communicates with the elbow pipe 2.

Accordingly, if electric power is supplied to the submersible pump 4 through a power line 8, the submersible pump 4 is driven, so that water within the water tank is discharged to the outside through the discharge port 7 of the submersible pump 4, the elbow pipe 2, and an exhaust pipe (not shown) coupled to a flange 2*b* on the outlet side of the elbow pipe 2. When the submersible pump 4 is driven, a high pressure occurs within the discharge pipe 7 of the submersible pump and the elbow pipe 2. Due to this, mutually pushing force occurs in the discharge pipe 7 and the elbow pipe 2 and therefore a gap is intermittently formed between the discharge pipe 7 of the submersible pump and the elbow pipe 2. Accordingly, a problem arises because the water discharged from the submersible pump 4 is leaked between the discharge pipe 7 and the elbow pipe 2.

The inventor of the present invention made an invention for preventing a phenomenon in which water leaks between a discharge pipe 7 of a submersible pump and an elbow pipe 2 and filed an application PCT/KR 03/01282.

An automatic discharge connection device of the submersible pump disclosed in PCT/KR 03/01282 includes, as shown in FIG. 2, a coupling member 10 coupled to the discharge port side of the submersible pump 4 so that the submersible pump 4 is coupled to the elbow pipe 2, and a sealing member 20 for preventing a water leakage by clogging a gap between the elbow pipe 2 and the coupling member 10 when the submersible pump 4 is driven.

The elbow pipe 2 has a flange 2*a* formed on the inlet side, and a pair of guide bars 3 to which the coupling member 10 is guided stands erect on both sides of the elbow pipe 2.

The submersible pump 4 has a flange 71 formed in the discharge pipe 7, and the coupling member 10 is coupled to the flange 71 by a bolt 72.

Meanwhile, the coupling member 10 includes a ring-shaped portion 11 fixed to the flange 71 of the submersible pump 4, and a sheet portion 12 extending from an upper side of the ring-shaped portion 11 to the guide bars 3. A stepped portion 13 into which the sealing member 20 is inserted is formed in the ring-shaped portion 11. A ring-shaped breakout prevention jaw 14 vertically adjoins the stepped portion 13 and protrudes toward a central portion of the ring-shaped portion 11.

The sealing member 20 is formed in a cylindrical form, and has an inclined front-end portion 21 formed therein such that the front-end portion 21 comes in contact with an inclined face 2*b* of the flange 2*a* on the inlet side the elbow pipe 2 with a wide area.

However, when the submersible pump 4 is actuated, reaction force A acts on the submersible pump 4 in an opposite direction to the elbow pipe 2, and pressure B caused by the weight of the submersible pump 4 and water within the water tank act on the submersible pump 4 in a downward direction of the submersible pump 4. The submersible pump 4 and the coupling member 10 are rotated upward in a counter-clockwise direction by means of a resultant force C of the reaction force A and the pressure B, so that a large gap is generated between the lower side of the ring-shaped portion 11 and the lower side of the inlet-side flange 2*a* of the elbow pipe 2. Accordingly, there was a problem that the sealing member 20 breaks away outwardly from the elbow pipe 2.

Further, the front-end portion 21 of the sealing member 20 of the submersible pump protrudes outwardly from the coupling member 10. Thus, when the submersible pump 4 is coupled to the elbow pipe 2, the front-end portion 21 of the sealing member is caught by the flange 2*a* of the elbow pipe 2 because the submersible pump 4 falls down. Accordingly, there was a problem that the submersible pump 4 could not be easily coupled to the elbow pipe 2.

DISCLOSURE OF INVENTION

Technical Problem

Accordingly, the present invention has been made in view of the above problems occurring in the prior art, and an object of the present invention is to provide an automatic discharge connection device of a submersible pump, which can certainly prevent a water leakage between the submersible pump and a feed pipe in which water discharged from the submersible pump is feed.

Another object of the present invention is to provide an automatic discharge connection device of a submersible pump, which can couple the submersible pump to a feed pipe easily.

Technical Solution

To accomplish the above objects, an automatic discharge connection device of a submersible pump in accordance with the present invention includes a submersible pump; a feed pipe for feeding water discharged from a discharge port of the submersible pump; a coupling member fixed to the discharge port of the submersible pump and located between the submersible pump and the feed pipe; and a sealing member having an one end portion inserted in an annular concave portion formed on an inner circumference of the coupling member, the sealing member sealing between-the coupling member and the feed pipe.

Meanwhile, a width in left and right directions of the concave portion is larger than a width in left and right directions of the one end portion of the sealing member inserted in the concave portion, so that the sealing member is movably disposed in left and right directions of the concave portion.

Further, a bump portion is formed at an end portion on the feed pipe of the coupling member, the bump portion protrudes toward a center of the coupling member, and the bump portion has an inside diameter greater than that of an inner circumference of the coupling member.

Further, the sealing member includes an annular vertical portion extending in a radial direction of the coupling member, a horizontal portion protruding toward one side from the vertical portion, and a downward curved portion curved downward from an end of the horizontal portion.

Meanwhile, it is preferred that an up/down length of the vertical portion be substantially the same as a depth of a lateral face on the discharge port side of the submersible pump, of a lateral face of the concave portion, and a distance between an outer end of the annular vertical portion and the horizontal portion be substantially the same as a depth of the bump portion on the pipe side, of a lateral face of the concave portion, which is formed adjacent to the concave portion on one side of the coupling member.

Further, an inner end of the downward curved portion more protrudes toward a center of the coupling member than an inner end of the vertical portion.

Meanwhile, a strut member having an inclined face in at least one of left and right sides is formed on a top of one side of the pipe. A protrusion member having an inclined face, which comes in contact with the strut member, protrudes in at least one of left and right sides of an upper portion of the coupling member.

Advantageous Effects

In the automatic discharge connection device of the submersible pump in accordance with the present invention, when the submersible pump is coupled to the feed pipe, the sealing member is not protruded outwardly from the coupling member coupled to the submersible pump. Accordingly, the coupling member can be coupled to the feed pipe easily. Further, the sealing member is installed in the concave portion formed on the inner circumference of the coupling member in such a way to move left and right. Thus, when the submersible pump is coupled to the feed pipe and the submersible pump is then actuated, the downward curved portion of the sealing member enters the feed pipe as the sealing member is moved toward the feed pipe along the concave portion by means of pressure of water discharged from the submersible pump and is then closely adhered to the inner circumference of the feed pipe. Accordingly, a gap between the coupling member and the feed pipe can be fully sealed and, therefore, the leakage of water discharged from the submersible pump can be prevented.

BEST MODE FOR CARRYING OUT THE INVENTION

Hereafter, an embodiment of the present invention will be described with reference to the accompanying drawings.

Figure 1:
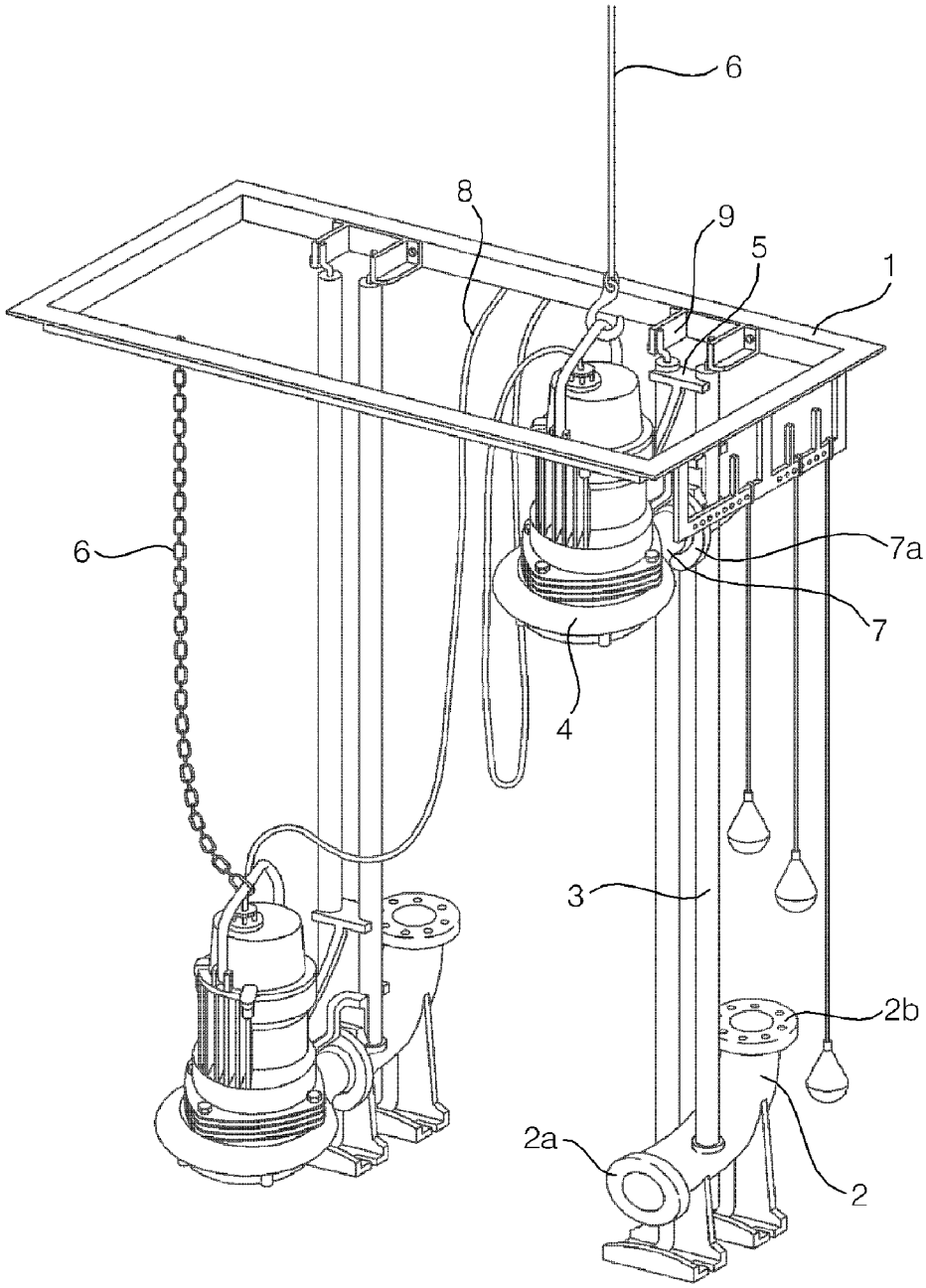
FIG. 1 is a perspective view showing an installation process of a typical submersible pump.
Figure 2:
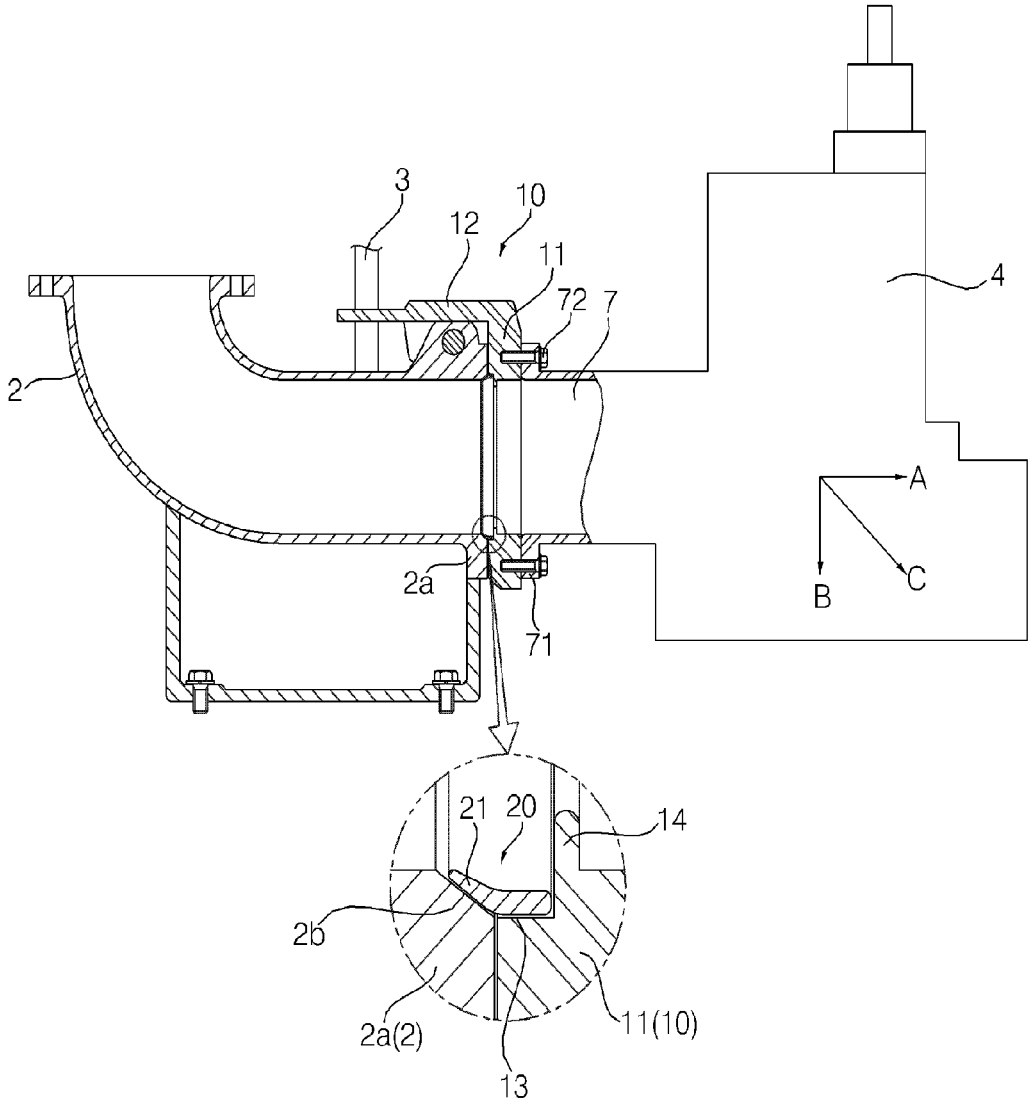
FIG. 2 is a cross-sectional view showing an automatic discharge connection device of a conventional submersible pump.
Figure 3:
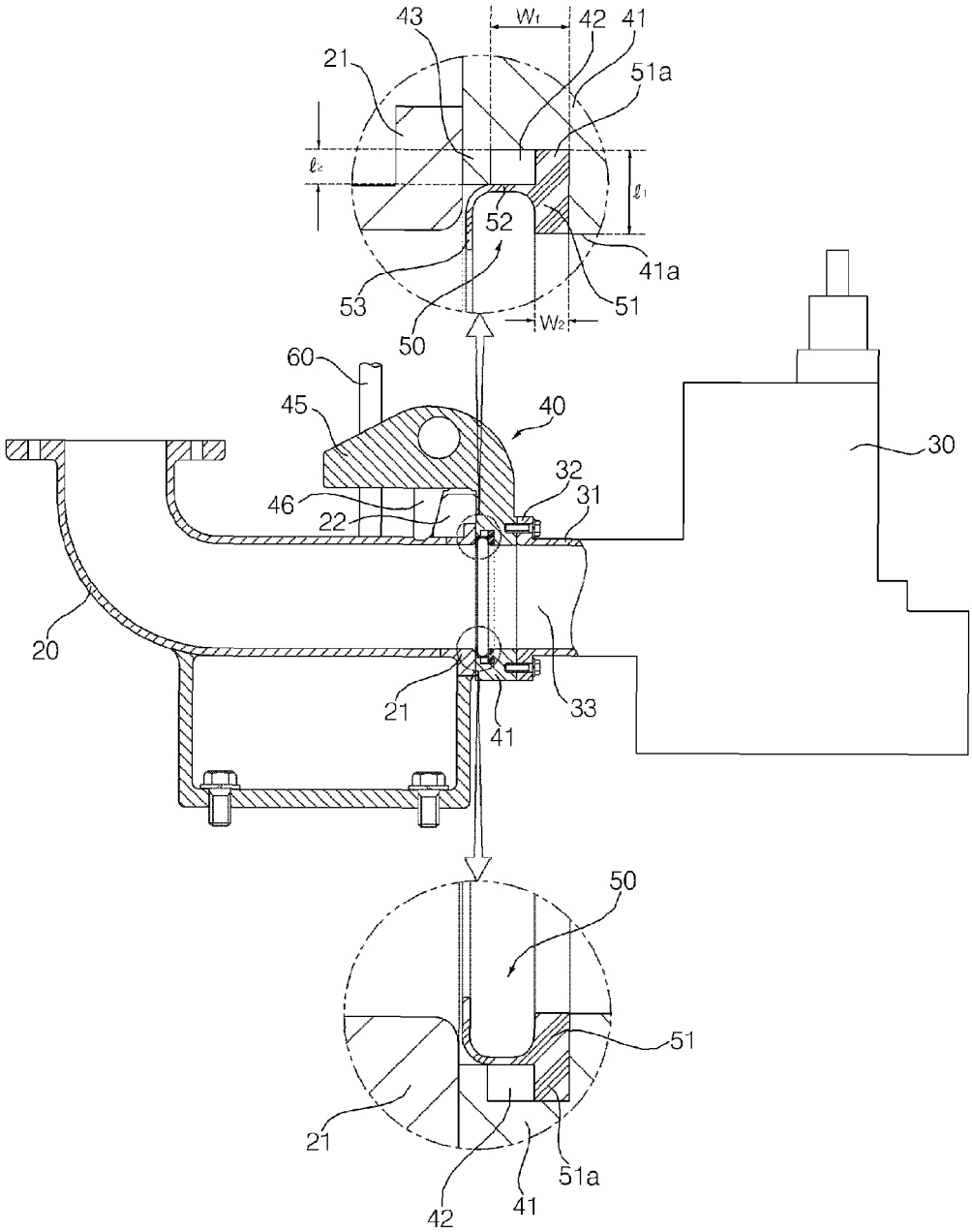
FIG. 3 is a cross-sectional view showing an automatic discharge connection device of a submersible pump in accordance with the present invention and is a diagram before the submersible pump is driven.
Figure 4:
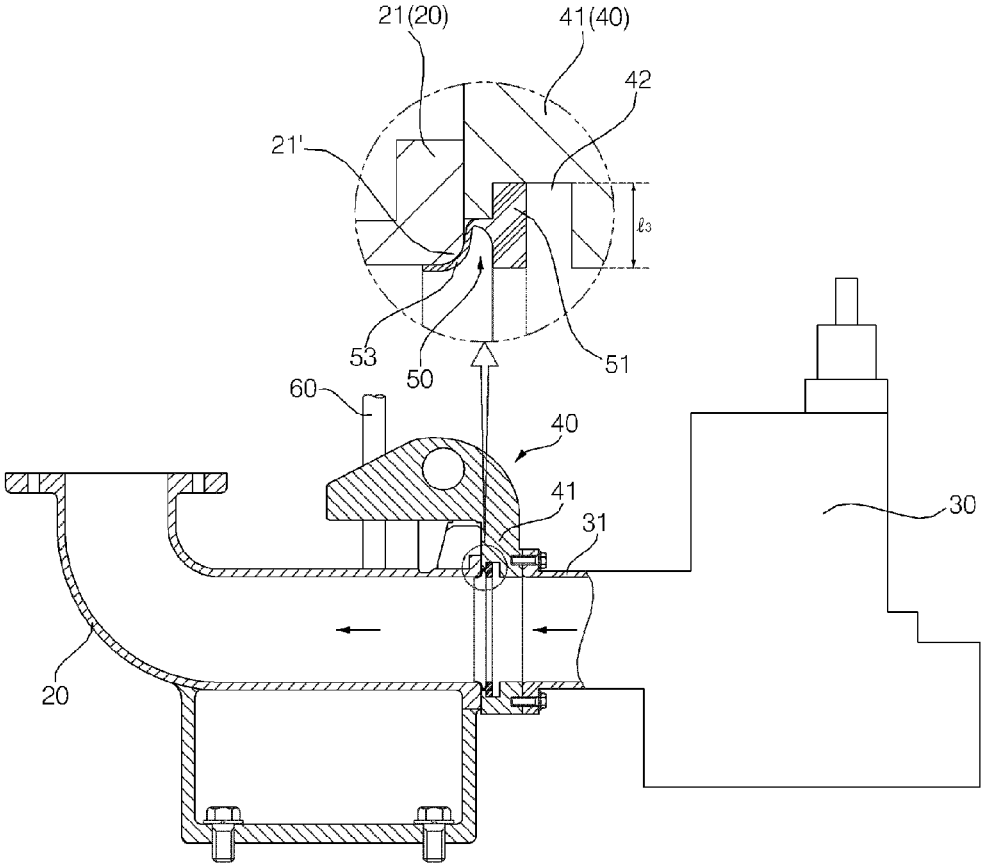
FIG. 4 is a cross-sectional view showing an automatic discharge connection device of a submersible pump in accordance with the present invention and is a diagram when the submersible pump is driven.

FIGS. 3 and 4 are cross-sectional views showing an automatic discharge connection device of a submersible pump in accordance with the present invention. FIG. 3 is a diagram showing a state where a submersible pump 30 is coupled to a feed pipe 20 and the submersible pump 30 is not actuated. FIG. 4 is a diagram showing a state where, when the submersible pump 30 is actuated, water is discharged through the feed pipe 20.

The automatic discharge connection device of the submersible pump in accordance with the present invention includes, as shown in FIG. 3, a submersible pump 30; the feed pipe 20 for feeding water discharged from a discharge port 33 of the submersible pump 30; a coupling member 40 fixed to the discharge port 33 of the submersible pump 30 and located between the submersible pump 30 and the feed pipe 20; and a sealing member 50 having a top end portion 51*a* inserted in an annular concave portion 42 formed on an inner circumference of the coupling member 40 and sealing between-the coupling member 40 and the feed pipe 20.

Figure 5:
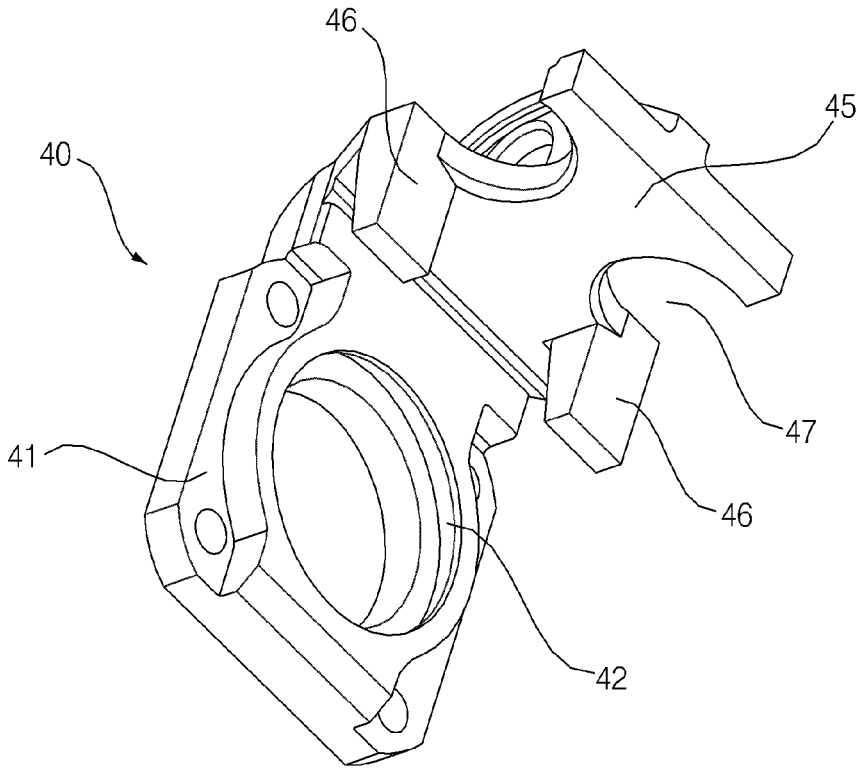
FIG. 5 is a perspective view showing a coupling member in accordance with the present invention.

As shown in FIG. 5, the coupling member 40 is formed vertically, and includes a vertical hollow sheet portion 41 having a space portion formed therein and a horizontal sheet portion 45 extending from a top end of the vertical hollow sheet portion 41 to one side. The concave portion 42 is formed on an inner circumference of the vertical hollow sheet portion 41.

Meanwhile, a width W1 in the left and right directions of the concave portion 42 is larger than a width W2 in the left and right directions of the top end portion 51*a* of the sealing member 50 inserted in the concave portion 42, as shown in FIG. 3. Thus, a space corresponding to a difference W1-W2 is generated between the sealing member 50 and the concave portion 42. Accordingly, the sealing member 50 is disposed in such a way as to move in the left and right directions of the concave portion 42.

The coupling member 40 includes a bump portion 43 protruding the center of the coupling member 40. The bump portion 43 is formed on a lateral side in the direction of the feed pipe 20. The bump portion 43 has an inside diameter, which is greater than that of an inner circumference 41*a* of the coupling member 40.

Figure 6:
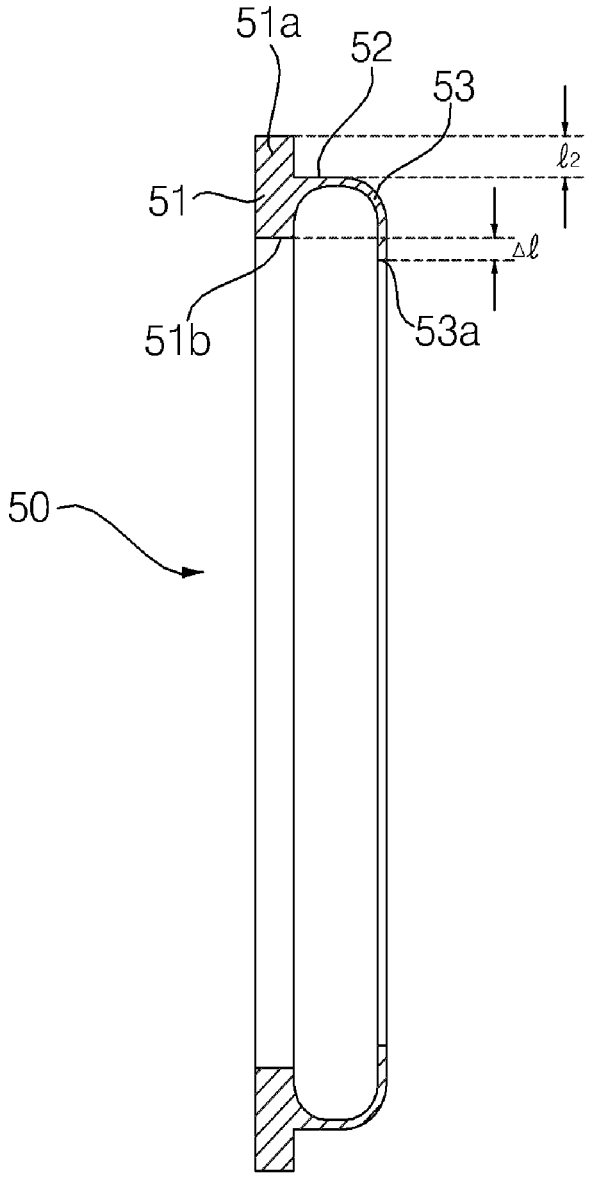
FIG. 6 is a cross-sectional view showing a sealing member in accordance with the present invention.

Meanwhile, the sealing member 50 includes, as shown in FIGS. 3 and 6, an annular vertical portion 51 extending in a radial direction of the coupling member 40 and having the top end portion 51*a* inserted in the concave portion 42, a horizontal portion 52 protruding from the vertical portion 51 to the feed pipe 20, and a downward curved portion 53 curved downward from the horizontal portion 52.

Further, the horizontal portion 52 preferably protrudes toward one side from a substantially central portion of the vertical portion 51, and between-the downward curved portion 53 and the horizontal portion 52 is preferably curved in an arc shape.

Further, an up/down length l1 of the vertical portion 51 is substantially the same as a depth l3 on the discharge port (33) side of the submersible pump 30, of the lateral side of the concave portion 42. Further, a distance l2 between an outer end portion of the vertical portion 51 and the horizontal portion 52 is substantially the same as the depth l2 of the bump portion. An inner distal end 53*a* of the downward curved portion 53 more protrudes toward the center of the coupling member 40 than an inner end 51*b* of the vertical portion 51 as shown in FIG. 6 by a specific length l.

Meanwhile, a strut member 22 having an inclined face is formed in at least one of the left and right sides on the top of one side of the feed pipe 20. The coupling member 40 includes a protrusion member 46 having an inclined face, which comes in contact with the strut member 22, in at least one of the left and right sides of the horizontal sheet portion 45. The protrusion member 46 protrudes downward.

Further, two guide bars 60 stand erect in the feed pipe 20. The coupling member 40 has arc-shaped dissected portions 47 formed on both sides of the horizontal sheet portion 45, as shown in FIG. 5. The guide bars 60 are placed in the dissected portion 47.

Meanwhile, the coupling member 40 is coupled to a flange 32 formed in the discharge pipe 31 of the submersible pump by means of a bolt.

An operation of the present invention constructed as above is described below.

First, the coupling member 40 is fixed to the flange 32 of the submersible pump 30 using a bolt, and the dissected portions 47 of the coupling member 40 are then inserted between the pair of guide bars 60. In this state, if the submersible pump 30 falls, one side of the vertical hollow sheet portion 41 is closely adhered to a flange 21 of the feed pipe 20 while the inclined face of the protrusion member 46 of the coupling member 40 is brought in contact with the inclined face of the strut member 22.

Here, the sealing member 50 having the top end portion 51*a* inserted in the concave portion 42 of the coupling member 40, as shown in FIG. 3, has the downward curved portion 53 not protruding outward from the coupling member 40. Therefore, the feed pipe 20 and the coupling member 40 can be closely adhered to each other conveniently without being interference by the sealing member 50.

If the submersible pump 30 is actuated in a state where the submersible pump 30 is coupled to the feed pipe 20 as shown in FIG. 3, water is discharged through the submersible pump 30, the coupling member 40, and the feed pipe 20. At this time, the pressure of water discharged from the submersible pump 30 exerts on the downward curved portion 53 of the sealing member 50, so that the sealing member 40 is moved toward the feed pipe 20 as shown in FIG. 4. Accordingly, the downward curved portion 53 enters the feed pipe 20 while surrounding an inner end portion 21' of the flange 21 of the feed pipe, thereby sealing between the coupling member 40 and the feed pipe 20.

Meanwhile, the length l1 of the vertical portion 51 of the sealing member 50 is identical the depth l3 of the concave portion 50, so that the water discharged from the submersible pump does not much experiences resistance of the sealing member 50. Further, the downward curved portion 53 more protrudes toward the coupling member than the vertical portion 51 by a specific length l, so that the downward curved portion 53 enters the inner end of the feed pipe 20 by means of the pressure of the water discharge from the submersible pump.

Meanwhile, the sealing member 50 is formed in such a way that the thickness of the vertical portion 51 is thicker than that of the horizontal portion 52 and the downward curved portion 53 so as to prevent deformation of the vertical portion 51. Although not shown in the drawings, the vertical portion 51 can be formed from material, which is more rigid than that of the horizontal portion 52 and the downward curved portion 53.

Meanwhile, if the actuation of the submersible pump 30 is stopped, the water within the feed pipe 20 flows backward to the submersible pump 30 and the pressure, which closely adheres the sealing member 50 to the inner end portion 21', decreases. Accordingly, the sealing member 50 returns to an original position, that is, a position shown in FIG. 3 by means of resilient force of the sealing member 50.

INDUSTRIAL APPLICABILITY

In the automatic discharge connection device of the submersible pump in accordance with the present invention, between-the submersible pump and the coupling pipe is completely sealed and water discharged from the submersible pump can be prevented from leaking between the submersible pump and the coupling pipe. Accordingly, the automatic discharge connection device of the submersible pump in accordance with the present invention can be widely used in submersible pumps for discharging water stored at a specific place.

The invention claimed is:

1. An automatic discharge connection device of a submersible pump, comprising:

a submersible pump;

a feed pipe receive fluid discharged from a discharge port of the submersible pump;

a coupling member fixed to the discharge port of the submersible pump and located between the submersible pump and the feed pipe; and a sealing member having an one end portion inserted in an annular concave portion formed on an inner circumference of the coupling member, the sealing member providing a seal between the coupling member and the feed pipe, wherein a width of the concave portion in an axial direction of the sealing member is larger than a width in the axial direction of the sealing member of the one end portion of the sealing member inserted in the concave portion, so that the sealing member is movably disposed in the concave portion in the axial direction of the sealing member, wherein the sealing member includes an extended portion that protrudes towards a center of a hollow of the coupling member, wherein when the sealing member moves towards the feed pipe, at least an end portion of the extended portion enters into the feed pipe such that the end portion is in close contact with an inner circumferential surface of the feed pipe to provide the seal between the coupling member and the feed pipe when the submersible pump is actuated, and wherein the sealing member moves towards the discharge port of the submersible pump and the end portion of the extended portion of the sealing member withdraws from the feed pipe when the submersible pump is stopped.

2. The automatic discharge connection device of claim 1, wherein a bump portion is formed at an end portion of the coupling member, the bump portion protruding toward the center of the hollow of the coupling member, and wherein the bump portion has an inside diameter greater than an inside diameter of an inner circumference of the coupling member.

3. The automatic discharge connection device of claim 1, wherein the sealing member comprises:

an annular vertical portion that extends in a radial direction of the coupling member; and a horizontal portion that protrudes from one side of the vertical portion, wherein the extended portion is curved downward from an end of the horizontal portion.

4. The automatic discharge connection device of claim 3, wherein the horizontal portion protrudes toward one side of the sealing member from a substantially middle portion of the annular vertical portion.

5. The automatic discharge connection device of claim 3, wherein a portion between the extended portion and the horizontal portion is curved in an arc shape.

6. The automatic discharge connection device of claim 3, wherein a length of the annular vertical portion is substantially the same as a depth of a lateral face of the concave portion on a side adjacent the discharge port of the submersible pump.

7. The automatic discharge connection device of claim 3, wherein a distance between an outer end of the annular vertical portion and the horizontal portion is substantially the same as a depth of a lateral face of the concave portion on a side adjacent the bump portion.

8. The automatic discharge connection device of claim 3, wherein an inner end of the extended portion protrudes toward a center of the hollow of the coupling member more than an inner end of the annular vertical portion.

9. The automatic discharge connection device of claim 1, wherein at least one strut member having an inclined face is formed on a top of one side of the feed pipe.

10. The automatic discharge connection device of claim 9, wherein the coupling member comprises at least one protrusion member having an inclined face that contacts the strut member, the protrusion member protruding from at least one of left or right sides of an upper portion of the coupling member.

11. A discharge connection device of a submersible pump, comprising:

a submersible pump;

a pipe that receives fluid discharged from a discharge port of the submersible pump;

a coupling member disposed between the discharge port of the submersible pump and the pipe; and a sealing member having an end portion inserted in an annular groove formed on an inner circumference of the coupling member and an extended lip that protrudes toward a center of a hollow of the coupling member, wherein a width of the groove is larger than a width of the end portion of the sealing member inserted in the groove so that the end portion of the sealing member is movable back and forth in the groove in a flow direction of the fluid, and wherein when the submersible pump is actuated, the sealing member moves toward the pipe and the extended lip of the sealing member is bent toward the pipe so that the extended lip seals a junction area between the coupling member and the pipe to prevent a leakage of the fluid between the coupling member and the pipe.

12. The discharge connection device of claim 11, wherein when the submersible pump is stopped, the sealing member moves back toward the submersible pump and the extended lip portion of the sealing member withdraws from the pipe.

13. The discharge connection device of claim 11, wherein an inner diameter of the extended lip of the sealing member is shorter than an inner diameter of the hollow of the coupling member.

14. The discharge connection device of claim 11, wherein the sealing member comprises:

a first portion that extends in a radial direction of the coupling member; and a second portion that protrudes from one side of the first portion, wherein the extended lip is curved and extends inward from an end of the second portion.

15. The discharge connection device of claim 14, wherein a thickness of the first portion of the coupling member is greater than a thickness of the second portion or the extended lip to prevent deformation of the first portion when the submersible pump is actuated.

16. The discharge connection device of claim 14, wherein a depth of the annular groove on a side which is close to the submersible pump is substantially the same as a length of the first portion, and a depth of the annular groove on a side which is close to the pipe is substantially the same as a length from an outer end of the first portion to an area, from which the second portion protrudes.

17. The discharge connection device of claim 11, wherein at least one strut member having an inclined face is formed on one side of the pipe.

18. The discharge connection device of claim 17, wherein the coupling member comprises at least one protrusion member having an inclined face that contacts the inclined face of the at least one strut member, the at least one protrusion member protruding from an upper portion of the coupling member.

* * * * *